United States Patent [19]

Jensen

[11] Patent Number: 4,625,206

[45] Date of Patent: Nov. 25, 1986

[54] SOUND PATTERN DISCRIMINATION SYSTEM

[75] Inventor: Marten C. Jensen, Scottsdale, Ariz.

[73] Assignee: Richard W. Clark, Scottsdale, Ariz. ; a part interest

[21] Appl. No.: 593,810

[22] Filed: Mar. 27, 1984

Related U.S. Application Data

[63] Continuation-in-part of Ser. No. 365,548, Apr. 5, 1982, abandoned.

[51] Int. Cl.[4] ..... G08G 1/00

[52] U.S. Cl. ..... 340/902; 340/901; 367/197

[58] Field of Search ..... 340/901, 902, 903, 904, 340/825.44, 825.48; 328/72, 75; 367/197, 198, 199

[56] References Cited

U.S. PATENT DOCUMENTS

| | | | |
|---|---|---|---|
| 2,811,708 | 10/1957 | Byrnes | 340/825.44 |
| 3,550,078 | 12/1970 | Long | 340/32 |
| 3,568,144 | 3/1971 | Streb | 340/34 |
| 3,670,242 | 6/1972 | McGarvey | 340/825.48 |
| 3,735,342 | 5/1973 | Helliker | 340/34 |
| 3,992,656 | 11/1976 | Joy | 340/32 |
| 4,162,477 | 7/1979 | Munkberg | 340/34 |
| 4,212,085 | 7/1980 | Vaillancour | 340/902 |

OTHER PUBLICATIONS

J. W. Verbeck, "Optics Operate Signals in Emergencies", The American City, Mar. 1967.

*Primary Examiner*—John W. Caldwell, Sr.
*Assistant Examiner*—Michael F. Heim
*Attorney, Agent, or Firm*—LaValle D. Ptak

[57] ABSTRACT

A system for the detection and recognition of a particular sound pattern including an initial frequency discrimination circuit comprising either band pass filters of pre-selected frequency or IC phase-locked loop tone decoders. A sequence detection circuit is responsive to the frequency discrimination circuit to successively enable paired timers upon detection of audio tones in the proper sequence and frequency. Out-of-sequence tones disable the circuit. A trigger pulse is then sent to a counter chain and successive pulse must be received by the counter chain in a predetermined time period to actuate a traffic signal control relay. The system used for a traffic signal control further includes a direction differentiation circuit to cause red lights in one direction and green lights in another as determined by the direction of the source of the sound pattern.

7 Claims, 11 Drawing Figures

FIG. 2
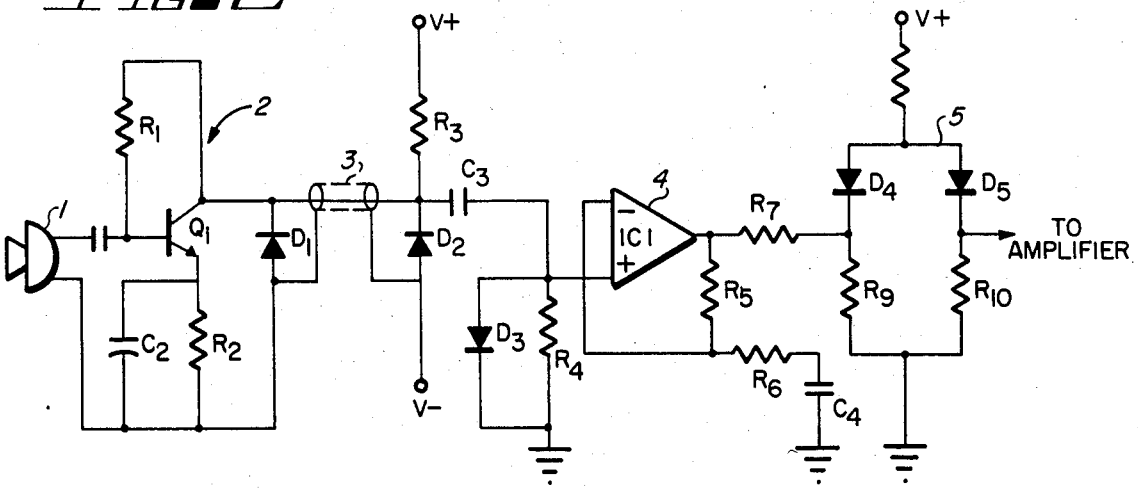
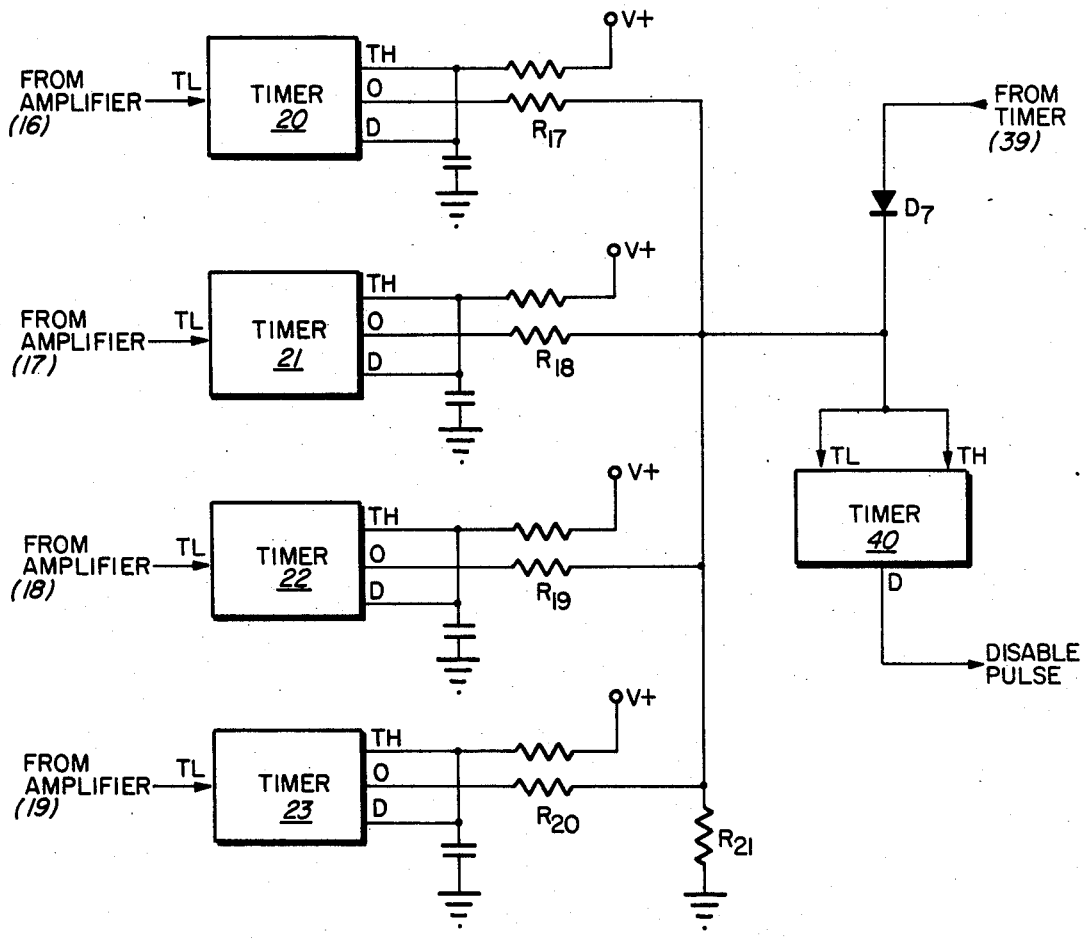
FIG. 7

FROM LOW-PASS FILTER (11)
12
IC4
IC5
IC6
IC7
16
TO TIMERS 20,24,38...

V+
R14
TIMER 41
TH
O
D
TL
C8
FROM TIMER(39)
ENABLE
TIMER 42
R15
C9
TIMER 47
TIMER 43
TIMER 44
TIMER 45
TIMER 46
R16
C10
48
CONTROL RELAY
COMMUTATION RELAY
N.O.
SCR

SOUND PATTERN DISCRIMINATION SYSTEM

RELATED APPLICATION

This application is a continuation-in-part of U.S. patent application Ser. No. 365,548, filed on Apr. 5, 1982, now abandoned.

BACKGROUND AND SUMMARY OF THE INVENTION

This invention relates an all-electronic system for the detection, recognition and positive identification of a particular repetitive or non-repetitive sound patterns and more particularly to an apparatus for the selective monitoring and recognition of emergency signals, such as sirens to remote control traffic signal devices.

Briefly, the present invention has primary application to detection of emergency signals and accomplishes its stated function by means of precise frequency discrimination circuits, sequence detection circuits, timed gating circuits, noise rejection circuits, comparator and preamplifier circuits, and repetition counting circuits. Consecutive tones of different frequency must occur to enable delay timers that emit a trigger pulse to a counter chain to actuate a traffic signal relay. Frequency discrimination is accomplished by band pass filters or by IC phase locked loop tone decoders. The various circuits can be readjusted to recognize almost any kind of predetermined repetitive sound pattern while retaining the ability to reject all other unwanted sounds.

The particular application and embodiments described are designed to detect and recognize the sound of a particular operating mode of an emergency vehicle siren known as a "yelp", for the purpose of controlling the traffic signals at an intersection making it easier and safer for the emergency vehicle to traverse the intersection. The system is capable of rejecting all extraneous sounds and sound combinations including other siren operating modes known as "wail" and "high-low". The system also is capable of North/South and East/West directional discrimination. The purpose of making the system responsive to the "yelp" operating mode is because that mode is normally used by emergency vehicle operators when they approach traffic intersections and, therefore, would entail little or no modification to the normal siren usage pattern. Should an emergency vehicle operator, for some reason, wish to make no change in the traffic signal cycle of an intersection he is approaching, he has the option of using any siren mode other than the "yelp".

By way of further explanation, the audio characteristic of the "yelp" operating mode consists of a continuously changing audio tone that begins at a frequency as low as 500 Hz and sweeps to a frequency as high as 1600 Hz and then sweeps back down again to the low frequency, this constituting a single sweep cycle. The sweep cycle is then repeated at a rate of one to four cycles per second. The exact frequency range covered and the exact sweep cycle repetiton rate depends on the particular model and type of siren. The circuits of the present invention accomodate and recognize the full range of "yelp" frequencies and repetition rates mentioned above.

The utility of a system whereby the traffic signals at an intersection are remotely controlled by the driver of an approaching emergency vehicle is thoroughly explained in U.S. Pat. No. 3,550,078, which discloses a system utilizing a photovoltaic detector at the traffic signal and a special high-intensity lamp mounted on each vehicle.

The prior art includes a number of systems having the capability of responding to particular sounds such as sirens or automobile horns. Representative systems are described in U.S. Pat. Nos. 3,568,144 and 3,735,342, both of which are designed to be mounted in a vehicle for the purpose of alerting the driver of the nearby presence of an emergency vehicle siren and, in one case, also the presence of an automobile horn and a train whistle. Neither of these patents make any mention of traffic signal control.

A system responsive to a predetermined pattern of sounds for controlling a traffic signal light is disclosed in U.S. Pat. No. 3,992,656. No directional discrimination capability, however, exists in the system disclosed in this patent.

Before reviewing the above patents in further detail, it is necessary to clarify the distinction between (1) the capability to respond to an audio tone or a predetermined sequence of tones with little or no ability to discriminate against unwanted audio signals that happen to contain the same tone or tone sequence (a tone decoder) and (2) the capability to detect and recognize a particular sound pattern along with the ability to reject all unwanted sounds and sound combinations (a sound pattern discriminator). The former (1) is typified, for example, by a telephone touch-tone system which establishes an artificial, controlled environment in which all the tones and tone sequences that can occur are known. A tone decoder, for instance, that is designed to respond to a predetermined tone sequence characterizing a seven-digit local telephone number would not respond to the first seven digits of any ten-digit, long distance number because the first seven digits of all ten-digit numbers never duplicate any seven-digit number. By the same token, any spurious signals that could cause false responses are adequately filtered or attenuated before reaching the tone decoder. Thus, in a controlled electrical environment, there is little need for the tone decoder to have any special means for rejecting unwanted signals because such signals are adequately attenuated beforehand or, by design, are not permitted to occur.

The latter, (2) is typified, for example, by a busy traffic intersection, which is a natural, uncontrolled environment in which a wide variety of unpredictable sounds and sound combinations may occur. A sound pattern discriminator, for instance, that is designed to detect and recognize the sound of an emergency vehicle siren, must be able to discriminate against and reject such sounds as engine exhaust noise, transmission gear whine, electric horns on automobiles, air horns on trucks, the screeching of brakes, the squealing of tires, and the ever-present, broad-band wind noise. Any circuit that is limited in its ability to reject such extraneous sounds, although it may be useful as as tone decoder in a controlled environment, has little practical value in an uncontrolled environment where it would generate a high percentage of false responses. It also is highly desirable for a system to be able to determine the direction from which the vehicle siren sound is coming for optimum control of the traffic light at an intersection.

Refer now to U.S. Pat. No. 3,568,144, which describes an apparatus, the preferred embodiment of which is claimed to be capable of responding to the sound of a train whistle, an automobile horn, and an emergency vehicle siren and display each response separately. It accomplishes this aim by means of three channels, the circuitry of each including a bandpass filter; one filter being tuned to the characteristic frequency of train whistles, the second being tuned to the characteristic frequency of automobile horns, and the third being tuned to the characteristic frequency of sirens.

The above described systems are not totally effective for two important reasons. First, the use of one bandpass filter to respond to the characteristic frequency of automobile horns does not work because automobile horns do not have a single characteristic frequency. The frequency of a horn varies with the make and model of automobile. Moreover, most automobiles carry two horns, one of low pitch and one of high pitch, to produce a more pleasing tone. If the pass band of the filter were made so broad so as to include the characteristic frequencies of most horns, the system would have no discriminating ability and would respond to most other sounds. Exactly the same reasoning holds true for a train whistle. Although the frequency range for various train whistles is narrower than various horns, the frequency range for whistles overlaps the frequency range for horns. Obviously, a siren does not have a single characteristic frequency, but sweeps a rather wide spectrum, as explained in a previous paragraph, which fully overlaps the frequency ranges of both horns and whistles. The second reason is that, even with narrow-band filters, the circuit has very poor discriminating ability. Most street noises have a complex spectrum that contains many audio components of different frequencies and these noises would cause almost constant false triggering, rendering the circuit useless.

Refer now to U.S. Pat. No. 3,735,342 which relates to a tone-responsive circuit capable of responding to the sound of an emergency vehicle siren. The system of this patent is an improvement over the previous circuits in that sounds of three different frequencies must be detected within a predetermined time period, ten seconds, by means of three bandpass filters before a response is obtained. An SCR sequencing circuit is used so the sounds must occur in a predetermined sequence. There is no delay time built into the sequencer except for the inherent turn-on time of an SCR which is typically less than 0.5 microsecond. Since the period of one cycle of a 1000 Hz tone is 1 millisecond, from a practical standpoint in audio work, a period as short as 0.5 microsecond may be considered to be instantaneous. Thus, three simultaneous tones at the proper frequencies will cause the circuit to respond, as will the same three tones occurring in any sequence whatever, so long as there is at least a 1 to 2 microsecond overlap. The system of this patent does not include any effective means of rejecting unwanted sounds and, therefore, can be easily triggered by any broad-band noise source. At best, this circuit may be considered to be a tone detector for a three-tone signal, but it would be ineffective as a useful sound pattern discriminator.

The system of U.S. Pat. No. 3,992,656 overcomes some, but not all, of the disadvantages of the above prior art systems. The '656 system detects siren frequencies in a sequential or reverse sequential, order to control a traffic signal light. This system, however, does not have the capability of directional discrimination, nor does it respond uniquely to a composite ascending-/descending sequence of frequencies.

BRIEF DESCRIPTION OF THE DRAWINGS

The present invention will be more fully understood from the following description and drawings in which:

FIG. 2 shows the circuit details of the preamplifier;

FIG. 7 illustrates the disable circuitry;

DETAILED DESCRIPTION

Figure 1A:
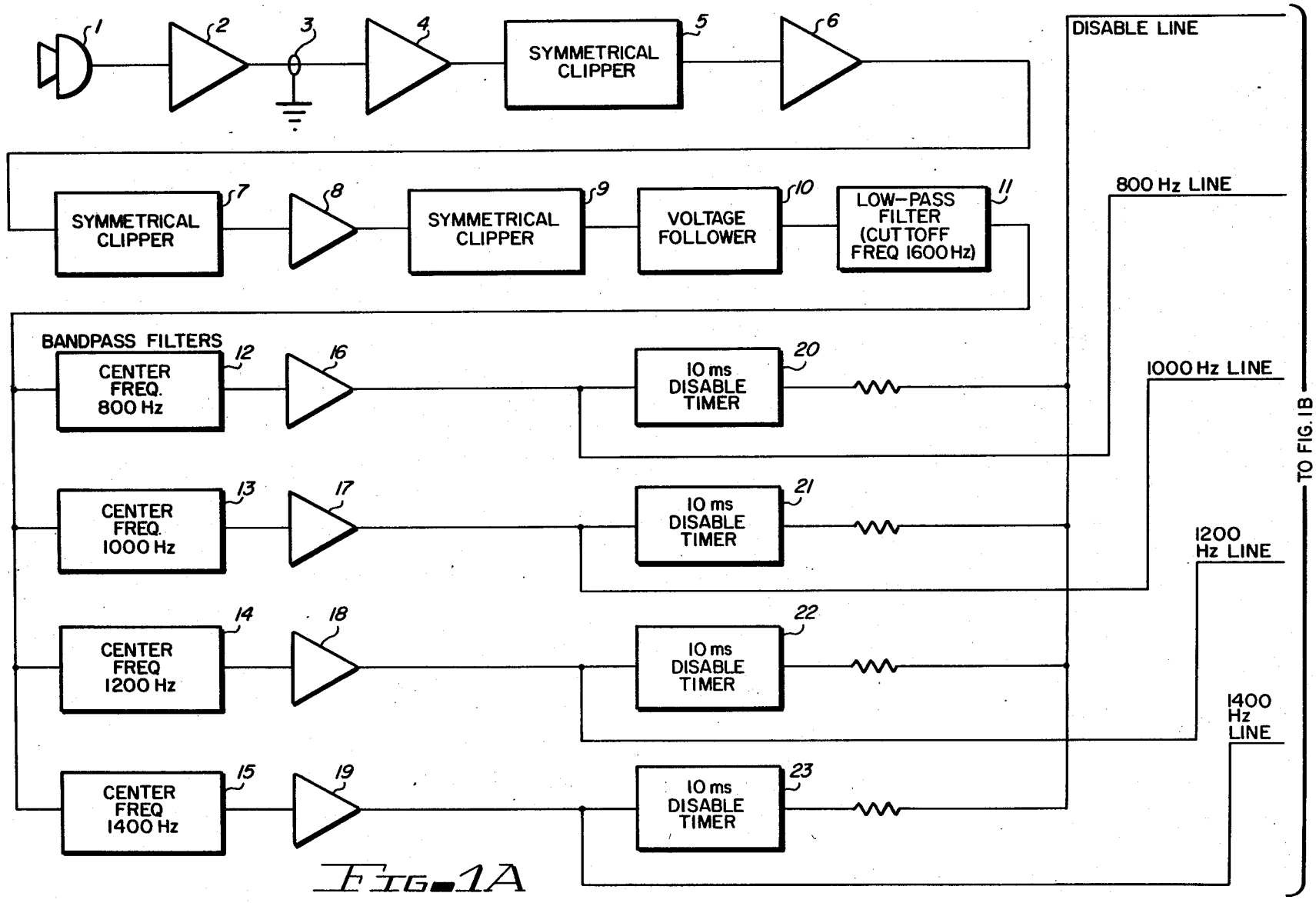
FIGS. 1A and 1B together are a block diagram of the circuitry of the system of a preferred embodiment of the present invention.
Figure 1B:
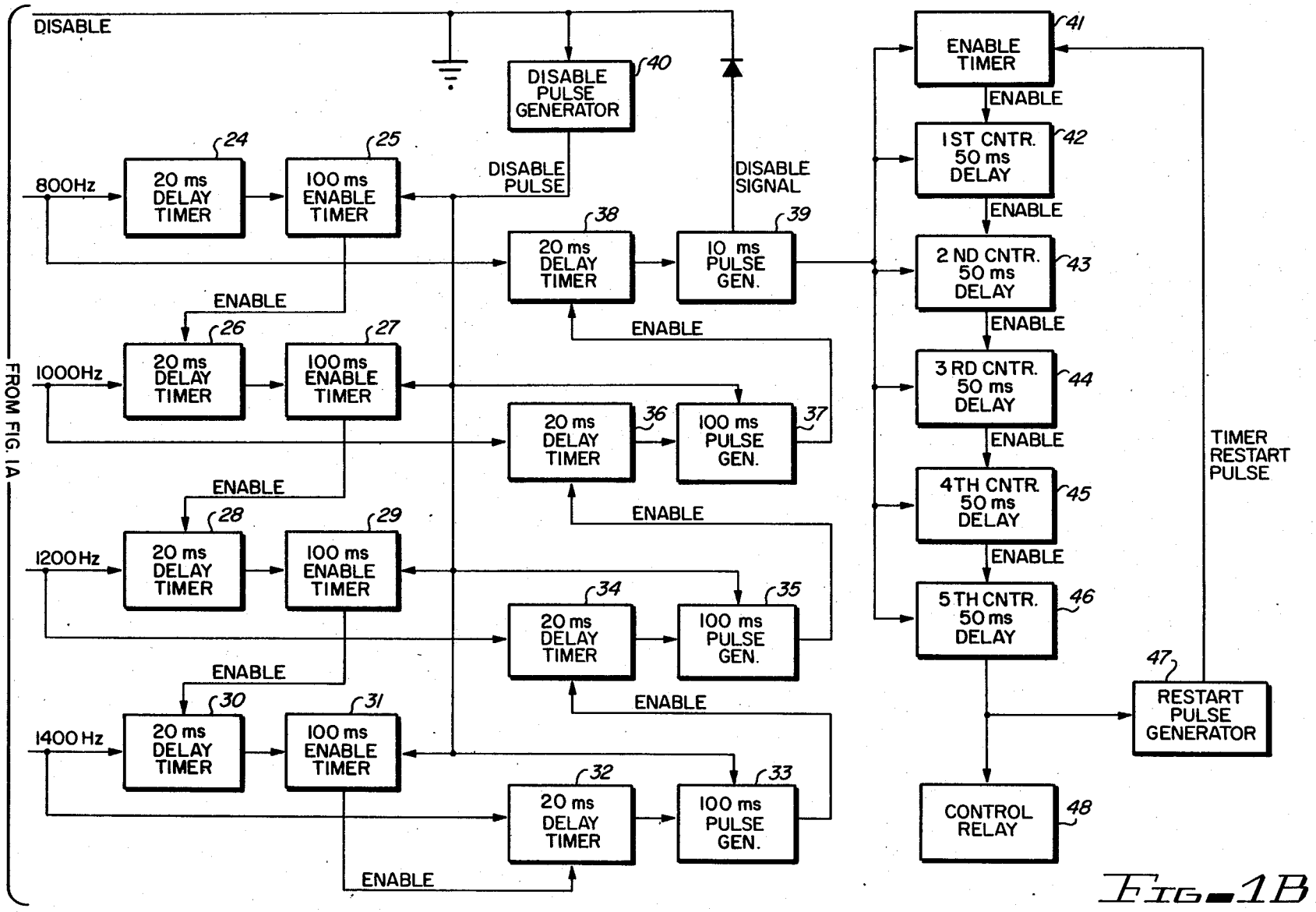
Figure 8:
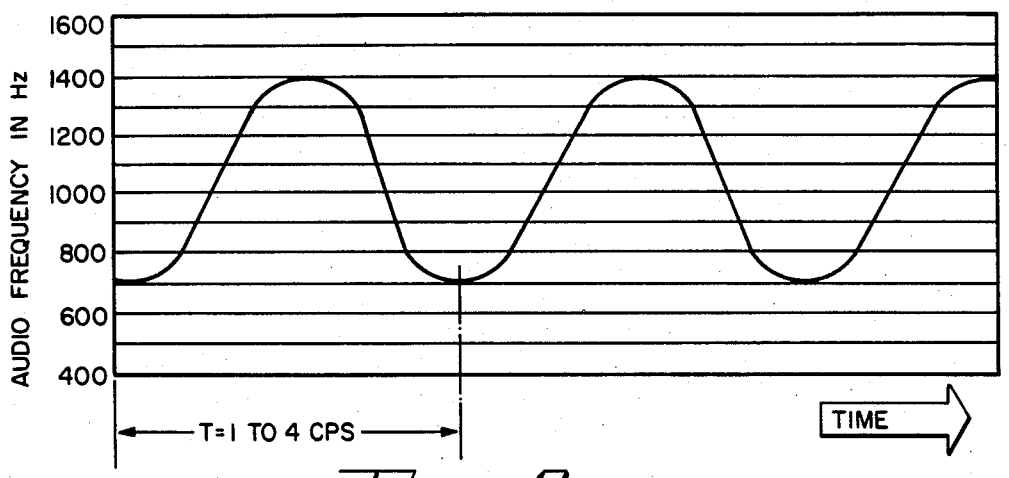
FIG. 8 graphically represents the typical "yelp" signal.

A block diagram of the overall electronic configuration is shown in FIGS. 1A and 1B. Referring to FIG. 1A, sound waves, for example, including a "yelp" operating mode as well as extraneous sounds, impinging on the microphone 1 are converted to electronic signals which are amplified by the pre-amplifier 2. The output signal from the pre-amplifier 2 is supplied to the input of the amplifier 4 by means of the shielded cable 3.

In an actual field installation, the wire connection between the microphone and subsequent circuits may be several hundred feet in length. This necessitates the use of shielded cable, as well as a suitable pre-amplifier that is located at or near the microphone to overcome the deleterious effects of induced noise and/or spurious signals.

The electrical signal from pre-amplifier 2 is further amplified by the amplifier 4, the output of which is passed through a symmetrical signal clipper 5 to prevent overloading at the input of the following amplifier stage 6, which if such overloading were allowed to occur, would cause distortion and the generation of undesirable harmonic energy. The amplifier and clipper combination is repeated twice more with clipper 7, 9 and amplifier 8. The output of the third clipper 9 is connected to a voltage follower 10 and to a low-pass filter 11 with a cutoff frequency of 1600 Hz. The purpose of the voltage follower 10 is to provide a proper impedance match between the clipper 9 and the low-pass filter 11. Amplifiers 4, 6 and 8 each have a built-in low-frequency roll-off characteristic with a cutoff frequency of 600 Hz. Thus, electrical signals outside the frequency band of interest are eliminated at this point, reducing a potential source of false triggering or improper operation of subsequent circuits due to spurious signals or harmonic distortion.

The output of the low-pass filter 11 is connected to the inputs of four high-Q bandpass filters 12, 13, 14 and 15, which are tuned to pass signals at nominal center frequencies of 800 Hz, 1000 Hz, 1200 Hz and 1400 Hz, respectively. The number of filters and their center frequencies may be varied in accordance with system requirements. Any signal from the output of the low-pass filter 11 that falls within the pass-band of one of the aforementioned bandpass filters is applied to the respective amplifier 16, 17, 18 or 19 which follows that bandpass filter and is amplified to a sufficient voltage level to act as a trigger signal for the timer circuits that are connected to the output of that amplifier.

The outputs of the four amplifiers 16, 17, 18 and 19 are connected to the trigger inputs of the timers 20, 21, 22 and 23, respectively, timers 24, 26, 28 and 30, respectively, and timers 38, 36, 34 and 32, respectively. Refer to FIG. 1B. Thus, a trigger signal at the output of the amplifier 16, for example, is simultaneously applied to the trigger inputs of timers 20, 24 and 38. In a similar manner, a trigger signal at the output of any of the other amplifiers is simultaneously applied to the trigger inputs of three timers, as seen in FIGS. 1A and 1B.

Of the eight timers shown in FIG. 1B that are connected to the outputs of the four amplifiers 16, 17, 18 and 19, only timer 24 does not require an enable signal before it can be triggered. Therefore, the only circuit action that can initially occur must be initiated by an 800 Hz signal, causing a trigger signal from the output of amplifier 16 to start a 20 millisecond timing period by timer 24. At the end of the 20 millisecond period, timer 25 initiates a 100 millisecond timing period during which it generates a continuous enable signal that is applied to timer 26. Thus, during the time period of 20 milliseconds to 120 milliseconds from the moment an 800 Hz tone was detected, timer 26 can be triggered by the detection of a 1000 Hz tone. If a 1000 Hz tones does not occur during this 100 millisecond period, no further circuit action will take place and the circuit will effectively revert to the condition existing prior to the detection of the 800 Hz tone.

If a 1000 Hz tone occurs during the designated time frame, causing timer 26 to be triggered, the same sequence of events as described above will occur, causing timer 38 to be enabled by timer 27 for a 100 millisecond period during which timer 28 can be triggered by a 1200 Hz tone. If timer 28 is successfully triggered, the sequence continues in the same manner, causing the successive enabling of timers 30, 32, 34, 36 and 38. For timer 38 to be successfully enabled and triggered requires the detection of eight audio tones in the following precise sequence: 800 Hz, 1000 Hz, 1200 Hz, 1400 Hz, 1400 Hz, 1200 Hz, 1000 Hz, 800 Hz. In addition, after the detection of the first 800 Hz tone, each successive tone must be detected within the period of 20 milliseconds to 120 milliseconds after the detection of the previous tone in the established sequence. Any out-of-sequence tone, other than an 800 Hz tone, that is detected will always encounter a disabled timer, effectively preventing any further circuit action.

Whenever timer 38 is successfully triggered, it activates, after a 20 millisecond delay, a 10 millisecond single-pulse generator 39 which provides a disable signal to the disable pulse generator 40 and a trigger pulse to the 5 second timer 41 and to all five counters 42, 43, 44, 45 and 46. Each counter, however, requires an enable signal in order to be triggered. The first counter 42 receives its enable signal from the output of the 5 second timer 41 and each succeeding counter receives its enable signal from the output of the preceding counter. When the first trigger pulse occurs, the 5 second timer 41 is triggered and immediatley provides an enable signal to the first counter 42 allowing it to be triggered as well. The second counter 43 receives its enable signal only after a 50 millisecond delay and can, therefore, not be triggered by the first pulse and must wait for a second pulse to occur. If timer 38 is successfully triggered a second time, a second trigger pulse will occur to trigger the second timer 43 which, after a 50 millisecond delay, will provide an enable signal to the third counter 44. In this manner, each succeeding pulse will trigger the next counter in sequence until the fifth pulse has triggered the fifth counter 46. Once the 5 second timer 41 has been triggered, however, succeeding pulses that occur within the 5 second period have no further effect on that timer.

If the 5 second timer 41 completes its timing period before the fifth counter 46 is triggered, the loss of the enable signal will immediately disable all five counters and effectively reset the entire counter chain. The next trigger pulse that occurs will then restart the 5 second timer 41 and retrigger the first counter 42, as before.

If the fifth counter 46 is triggered before the end of the 5 second timing period, it will actuate the traffic signal control relay 48 and at the same moment provide a restart pulse 47 to the 5 second timer 41 which will, without interruption, initiate a new 5 second timing period. At this time, all five counters are triggered, all enable signals are present, and the control relay is activated. Succeeding trigger pulses have no further effect on the counter chain except that each pulse initiates a new timer restart pulse 47. If no trigger pulse occurs for a period of 5 seconds, the 5 second timer 41 will complete its timing period causing loss of the enable signal, resetting of the timer chain, and deactivation of the traffic signal control relay 48.

The operation of the disbale circuits is controlled by the disable pulse generator 40 which, when provided with a suitable disable signal, generates a disable pulse that is connected to each of the seven 100 millisecond enable timers 25, 27, 29, 31, 33, 35 and 37. This causes a loss of all enable signals and effectively resets the timer circuits. The disable signals provided to the disable pulse generator 40 can come from either of two sources. One source is the 10 millisecond pulse generator 39, which generates a signal 20 milliseconds after timer 38 is triggered for the purpose of resetting the timer circuits after the successful detection of the complete sequence of eight tones and in preparation for the next sequence of tones. Such resetting assures that the various circuits are in their proper initial states regardless of any spurious signals or false triggering that may have occurred.

The second source of disable signals is from the resistance network connected to the outputs of the four 10 millisecond disable timers 20, 21, 22 and 23 shown in FIG. 1A. Each of these timers produces an output signal for a 10 millisecond period whenever it is triggered by a trigger signal from the output of its associated amplifier 16, 17, 18 or 19. The output signals from all four timers are summed by means of a resistance network so that a disable signal is produced only when all four timers are simultaneously triggered. This situation would occur only if 800 Hz, 1000 Hz, 1200 Hz, and 1400 Hz tones were all detected within a 10 millisecond time span. The purpose of this circuit is to eliminate the possibility of false triggering by broad-band noise.

This contemplates the description of the block diagrams in FIGS. 1A and 1B. In view of the uniqueness of the individual circuits, the following more detailed description is believed helpful to a full and complete understanding of the invention.

Although almost any type of audio transducer 1 can be used and its electrical characteristics are not particularly critical, a dynamic moving-coil-type of microphone element is recommended because of several favorable characteristics including low-cost, physical ruggedness, and smooth frequency response over the bandwidth of interest. The microphone housing should not only be designed to be weatherproof and adequately rugged, but should also be designed to minimize the generation of localized (at the housing) wind noise to reduce the amount of broad-band noise pickup. The housing should also be designed to minimize vertical sensitivity and maximize horizontal sensitivity in order to reduce traffic noise pickup from directly below the microphone.

The pre-amplifier 2 shown in FIG. 2 is designed to be remotely located at or near the microphone and is connected to the amplifier 4 by means of shielded cable 3. The circuit configuration of the pre-amplifier 2 is unique in that the connection to the amplifier 4 requires only a single-conductor wire plus a shield, which, for long shielded cable runs can result in considerable cost saving over the use of multi-conductor wires. This was accomplished by connecting the base bias resistor, R1, directly to the collector terminal of transistor Q1 and moving the collector load resistor, R3 to the far end of the shielded cable. By this means, both the d.c. collector current and the amplified a.c. signal are carried by the single-conductor wire, while both the d.c. and a.c. return currents are carried by the shield. Other bias arrangements or the use of a multi-stage amplifier would require at least a two-conductor wire plus shield. The use of an integrated circuit operational amplifier would require a three-conductor wire plus shield.

The remaining components in the pre-amplifier 2 consist of a capacitor C1 which couples the signal from the microphone to the base of transistor Q1, emitter stabilization resistor R2, emitter bypass capacitor C2, and capacitor C3 which couples the signal to the input of amplifier 4. Diodes D1 and D2 serve to proect circuit components from the adverse effects of reverse-polarity overvoltage signals induced at or near the shielded cable 3 or its connections. Although D1 and D2 are diagrammed as signal diodes, zener diodes may be used effectively.

Amplifier 4 is an integrated circuit operational amplifier, IC1, connected in a non-inverting, high-gain configuration. In the interest of simplicity, supply voltage terminals are not shown. Resistor R4 provides a ground reference for the non-inverting input, diode D3 protects the input from forward-polarity overvoltage signals. Resistor R5 provides a signal feedback path to the inverting put, resistor R6 and capacitor C4 control the roll-off characteristic by establishing the low-frequency cutoff frequency of the amplifier, and resistor R7 provides load isolation between amplifier 4 and clipper 5.

Symmetrical signal clipper 5 is a standard clipper configuration consisting of resistors R8, R9 and R10 and diodes D4 and D5. Amplifiers 6 and 8 in FIG. 1A are similar to amplifier 4 and clippers 7 and 9 are similar to clipper 5. The use of a multiplicity of high-gain amplifiers and symmetrical clippers in this fashion is a unique technique for amplifying a very weak signal to a usable level in the presence of very strong signals without generating excessive distortion products.

Figure 3:
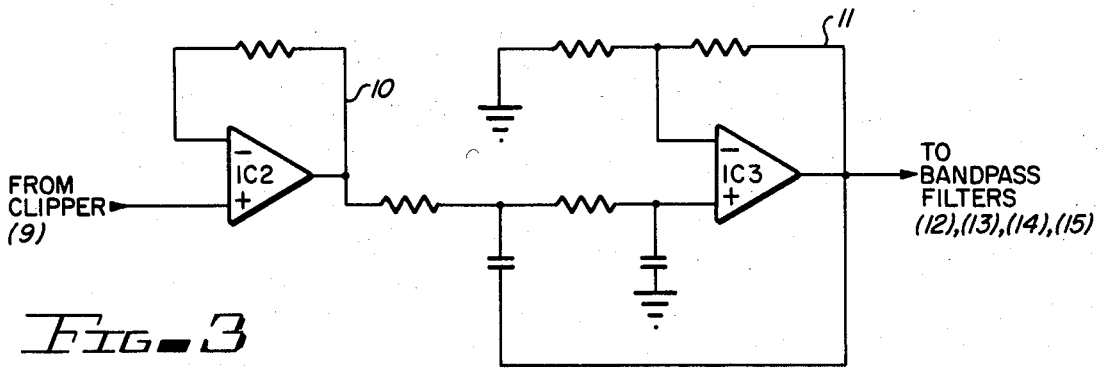
FIG. 3 shows the circuit details of voltage follower and band pass circuits.
Figure 4:
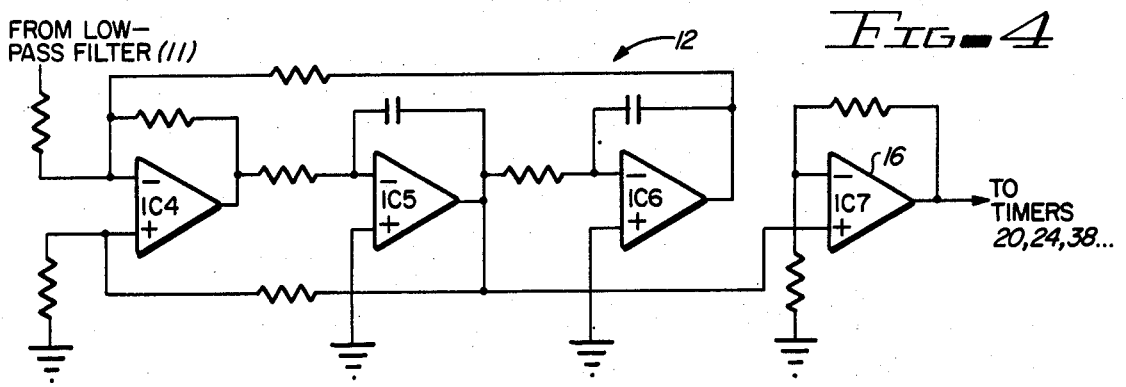
FIG. 4 is a detail representative of the band pass filters.

The voltage follower 10 shown in FIG. 3 is a standard configuration consisting of IC2 and a feedback resistor. The low-pass filter 11, consisting of IC3 and its associated components, is a second-order active filter utilizing a Sallen-Key circuit configuration. Both IC2 and IC3 are integrated circuit operational amplifiers. The bandpass filter 12 as seen in FIG. 4, consisting of IC4, IC5, IC6 and their associated components, is a high-Q, second-order active filter utilizing a state-variable circuit configuration. Amplifier 16, consisting of IC7 and a feedback network, is a standard non-inverting operational amplifier. The configurations of all four bandpass filters 12, 13, 14 and 15 are similar and the configurations of all four amplifiers 16, 17, 18, and 19 are similar.

Figure 5:
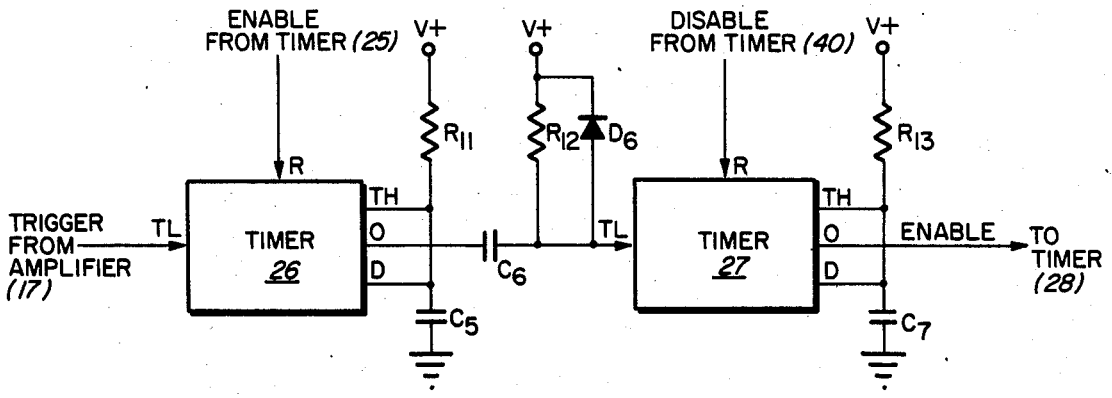
FIG. 5 is a typical timer configuration.

Of the eight pairs of timers 24 through 39 shown in FIG. 1B, the circuit configuration for one typical pair of timers is shown in FIG. 5. Timer 26 and timer 27 are both integrated circuit timers (such as Signetics SE 555), the terminal designations for which are defined in the legend in FIG. 5. In the interest of simplicity, the supply voltage and ground terminals are not shown. Timer 26 is connected as a monostable circuit such that when an enable signal from timer 25 is present, a negative-going pulse of sufficient amplitude applied to terminal TL will cause the output to go high for a predetermined length of time, the period of which is established by the values of resistor R11 and capacitor C5. In this case, the period is 20 milliseconds. Timer 27 is also connected as monostable circuit with timing components R13 and C7 of the proper values to establish a timing period of 100 milliseconds. Resistor R12 and capacitor C6 comprise a differentiation network that modifies the output pulse from timer 26 such that timer 27 does not trigger until the end of the 20 millisecond period. Diode D6 prevents the input signal from exceeding the supply voltage, a condition that could damage timer 27. When timer 27 is triggered, the enable line to timer 28 goes high for a period of 100 milliseconds. At any time during this period, a disable pulse from timer 40 will terminate the timing period and thereby terminate the enable signal to timer 28. The configurations of all eight pairs of timers are similar except that the R terminal of timer 24 is connected to the positive supply so that it is always enabled, and the values of the timing components for timer 39 are modified to produce a 10 millisecond period instead of a 100 millisecond period.

Figure 6:
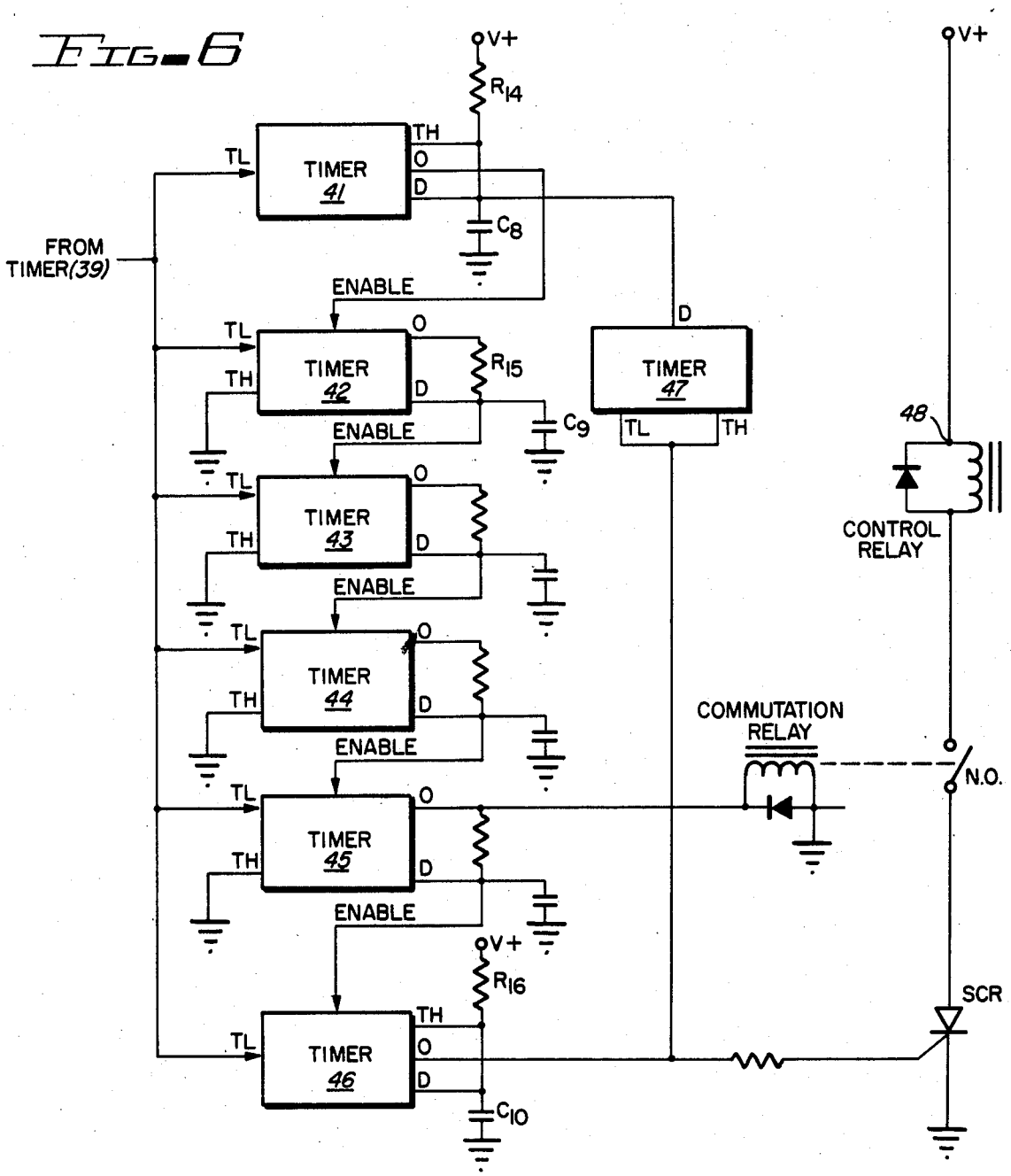
FIG. 6 shows the circuit configuration of the counter chain and control relay.

FIG. 6 shows the circuit configuration of the counter chain and the control relay actuation circuitry. All the timers 41 through 47 are integrated circuit timers (such as Signetics SE 555), the terminal designations for which are defined in the legend in FIG. 5. Supply voltage and ground terminals are not shown. Timer 41 is connected as a monostable circuit, with timing components R14 and C8 of the proper values to establish a timing period of 5 seconds during which an enable signal is provided to timer 42. Timer 42 is connected as a Schmitt trigger and the 50 millisecond delay before an enable signal is provided to timer 43 is controlled by the values of R15 and C9. This circuit configuration is repeated with timers 43, 44 and 45. When timer 45 is triggered, the commutation relay is energized causing its normally open contacts to close, thereby completing the circuit between the SCR and the control relay. Timer 46, which is the fifth counter in the chain, is connected as a monostable circuit, with timing components R16 and C10 of the proper values to establish a timing period of 40 microseconds. When timer 46 is triggered, the resulting 40 microsecond pulse is applied to the gate of the SCR causing it to turn on, thereby energizing and latching the traffic signal control relay. At the same moment, the 40 microsecond pulse is also applied to timer 47, which is connected as a Schmitt trigger, causing capacitor C8 to discharge, which has the effect of restarting the 5 second timing period without interruption. If timer 46 is not retriggered within a 5 second period, the loss of the enable signals will cause the commutation relay to drop out, which by disconnecting the ground line through the SCR, will cause the traffic signal control relay to drop out.

The disable circuitry is shown in FIG. 7. All five timers are integrated circuit timers, the terminal designations are defined in the legend in FIG. 5. Supply voltage and ground terminals are not shown. Four of the timers, 20 through 23, are connected as monostable circuits with a timing period of 10 milliseconds. The outputs of these timers are connected to a summing network consisting of resistors R17, R18, R19, R20 and R21. Timer 40, which is connected as a Schmitt trigger, produces a disable pulse whenever its input reaches a predetermined threshold level. The summing network is arranged so that the required threshold is only attained when all four timers, 20 through 23, are triggered at the same time, that is, within 10 milliseconds of each other. Timer 40 will also produce a disable pulse when it receives a pulse from timer 39 through diode D7. The purpose of diode D7 is to isolate timer 39 from the summing network.

In an alternate version of this system, each bandpass filter and amplifier combination such as 12 and 16, 13 and 17, 14 and 18, or 15 and 19, may be replaced by an integrated circuit phase-locked-loop tone decoder. Phase-locked-loop tone decoders are available as single integrated circuits with input and output characteristics and supply voltage requirements such that they can be suitably used as direct replacements for the bandpass filter and amplifier combinations. The choice between bandpass filter circuits or phase-locked-loop circuits in this system would be based on the nature of the sound or sound combination that is to be detected as well as cost versus performance trade-off considerations for each situation.

The circuit which has been described thus far is a very effective traffic signal light control system which responds to the wailing or "yelp" mode of operation of an emergency vehicle siren to produce an output signal which may be used to control the condition of a traffic light at an intersection. A disadvantage of this system which has been described thus far, however, is that it does not have a capability of determining the direction of approach of emergency vehicles to the intersection. Consequently, when a system of the type which has been described and which is shown in FIGS. 1 through 7 is employed, the output which is produced normally is used to cause the traffic signal light either to turn to a red or stop condition, or a flashing red condition, in all four directions. Where the intersection being controlled is one which handles heavy traffic, this sometimes may result in a clogging or blocking of the intersection, since vehicles approaching the intersection stop in all four directions. Furthermore, if two emergency vehicles approach the intersection from right angle directions, neither of them will be aware of the other and both may assume that the traffic signal light control is effected as a result of their own individual siren. This could result in a serious accident between the emergency vehicles, both of which would proceed to pass through the red light condition of the signal light, thinking they were the only vehicle approaching that intersection. Consequently, a directional control of the signal light which produces a green light in one direction (such as North-/South) and a red light condition in the other direction (such as East/West) for the emergency vehicle which first approaches the intersection is highly desirable. Such a system is shown in FIG. 9.

Figure 9A:
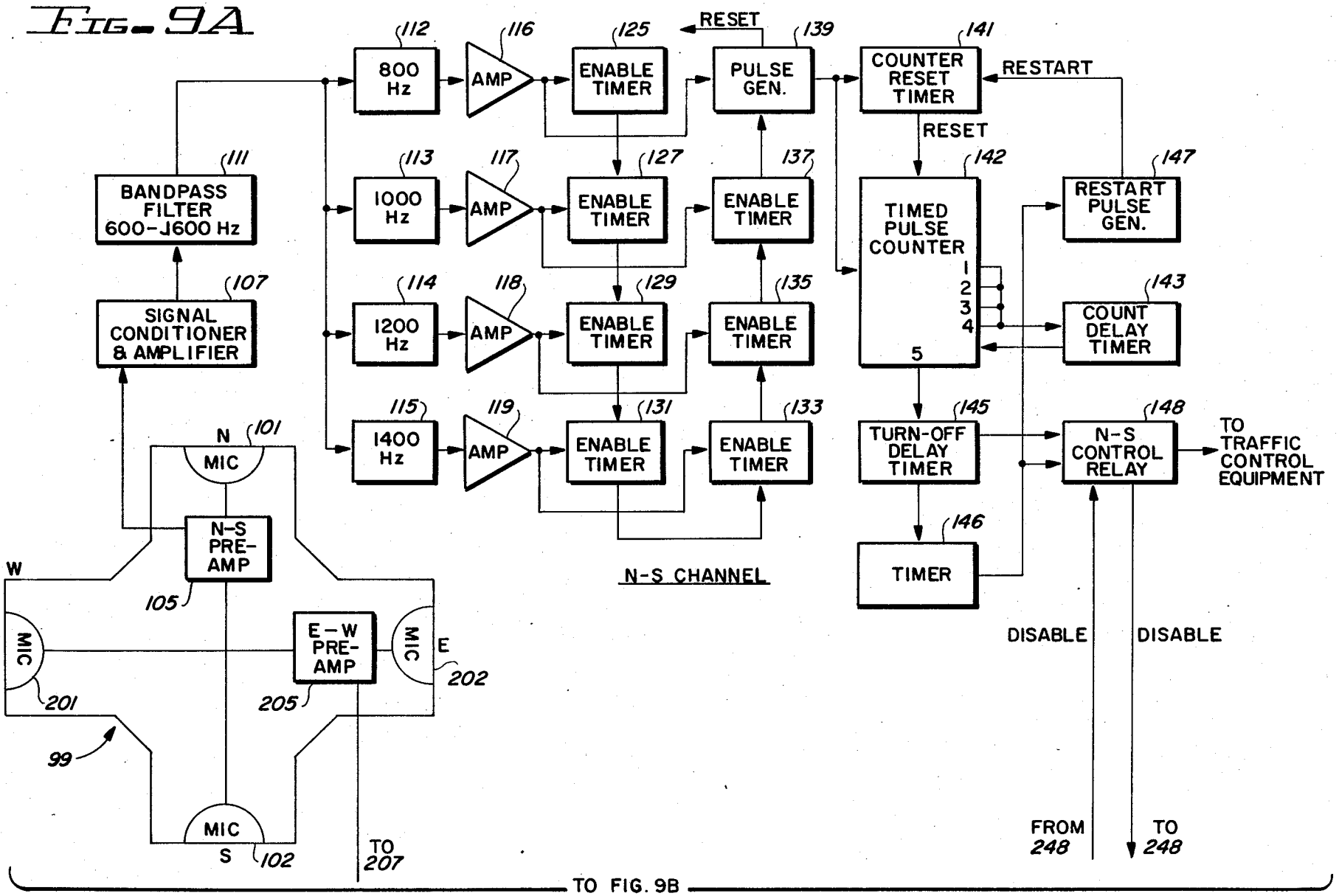
FIGS. 9A and 9B together are a block diagram of another embodiment of the invention, with directional discrimination capabilities.
Figure 9B:
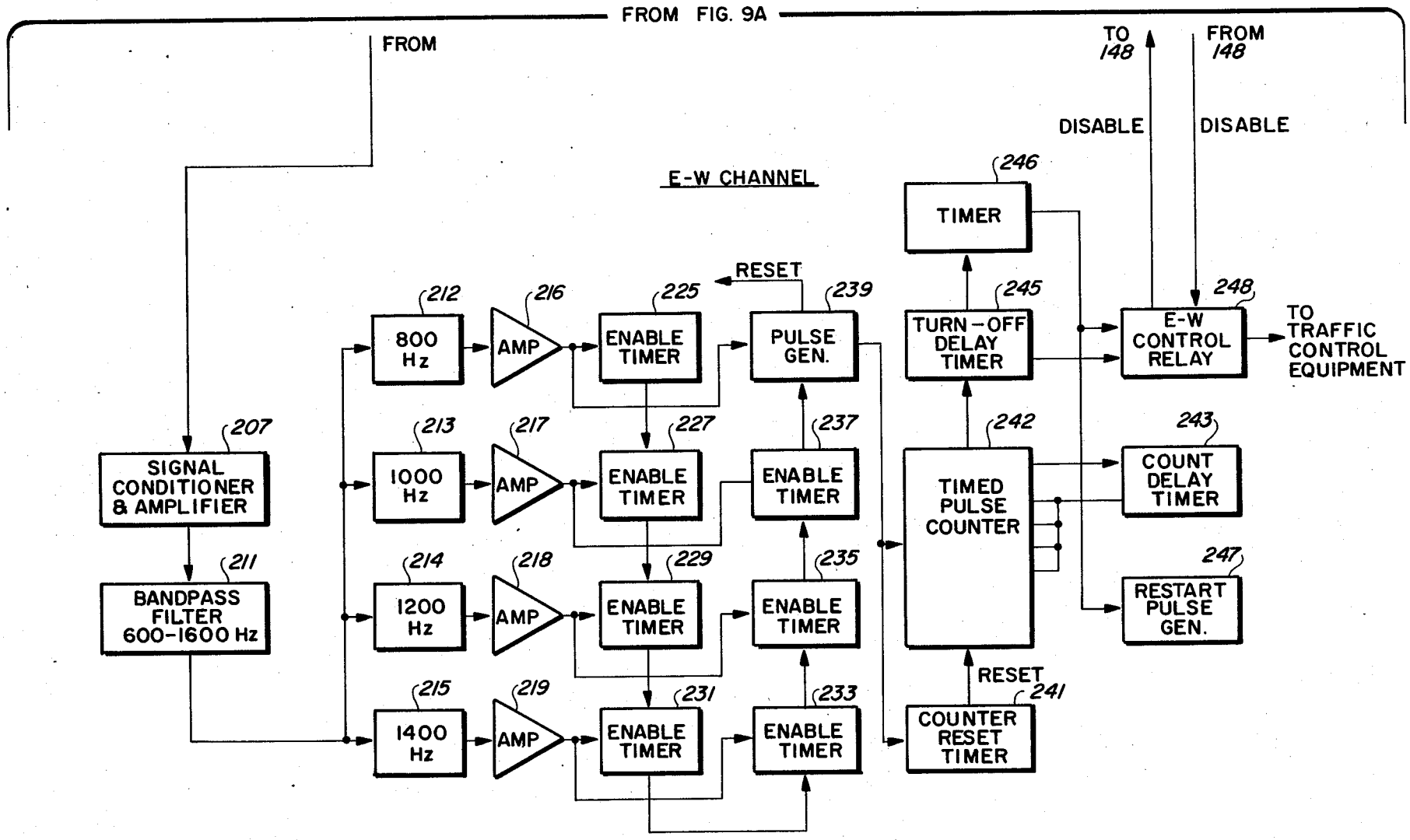

The system of FIG. 9 esentially comprises two systems of the type which are shown in FIGS. 1A and 1B. One of the systems controls the traffic lights in the North/South direction, and the other duplicate system controls the traffic lights in the East/West direction. In all other respects, the two systems are the same aas the one which has been described previously in conjunction with FIGS. 1A and 1B and operate in the same manner described in conjunction with FIG. 1. As a consequence, the reference numbers which are used in FIG. 9 are the same as those used in FIGS. 1A and 1B for the same or similar components, with the exception that the system for the North/South signal light control is designated as a 100 series of numbers, while the East/West control components are designated with a 200 series of numbers. The individual numbers within these series, however, are the same as the same or similar components in FIGS. 1A and 1B, so that correlation between the circuit components shown in FIG. 9 with those which already have been described in conjunction with FIGS. 1A and 1B readily may be made. In addition, since this similarity does exist, no repetition of the operation of the detailed portion of the system to produce the output signal used for the traffic control output will be made here. The discussion of FIG. 9 which follows simply is directed to the implementation of the basic system which permits it to become a directional system.

At the left-hand side of FIG. 9, a traffic intersection 99 is indicated. Sound at this intersection is detected by four highly-directional microphones 101, 102, 201, and 202, which typically are mounted within a single weather-proof enclosure at a central position in the intersection 99. The North-facing and Souh-facing microphones 201 and 202, respectively, are connected to inputs to a North-South (N-S) differential amplifier or comparator circuit preamplifier 105 which produces an output when the two inputs differ more than a preestablished amount from one another. Similarly, the East- and West-facing microphones 202 and 201, respectively, are connected in a similar manner to an East-West (E-W) preamplifier 205.

The differential microphone connections from the directional microphones result in a very high front-to-side signal ratio, thus, greatly enhancing the directional quality of the microphones. The system also permits the four-direction input to be resolved into two electronic channels for controlling the signal lights in a normal pattern, with green lights in one or the other of the North-South or East-West directions, and red lights in the othe.

In a typical operational situation, the siren of an emergency vehicle approaching for example, from the North, produces a very high output from the North microphone 101 and almost no output from the South microphone 102. This results in a net difference signal that is very high, enabling the preamplifier circuit 105 to pass the signals from the microphone 101 to a signal conditioner and amplifier stage 107. The stage 107 essentially comprises the components 2 through 10 of FIG. 1A, and is comparable to those components in its makeup and operation.

At the time the condition described above takes place, however, the East and West microphones 202 and 201 both produce moderately low outputs which are about equal to one another. As a consequence, the net difference signal produced from the microphones 201 and 202 is close to zero, and the East-West preamplifier 205 is not enabled. Thus, no output is passed from the preamplifier 205 to its corresponding signal conditioner and amplifier 207 which is identical in circuit construction to the signal conditioner and amplifier 107.

Since the N-S channel and the E-W channels are identical, the following description refers only to the N-S channel, which has been selected in the example presently under consideration. It should be understood, however, that the discussion directed to the N-S channel applies equally as well to the E-W channel whenever that channel is selected by an approaching emergency vehicle from either the East or West directions.

The signals from the output of the signal conditioners and amplifier circuit 107 are applied to a bandpass filter 111, which is comparable to the filter 11 shown in FIG. 1A. The signal conditioner amplifier and circuit 107 consists of special noise cancellation circuits and a logarithmic compressor to prevent overloading of subsequent circuits whenever a siren is located near the microphones 101, 102, 201 or 202. The filter 111 eliminates frequencies outside of the range of interest, as described previously. The remaining components of the N-S channel are comparable to the similar components with the same reference numbers (but without the 100 series addition) so that further description of the operation of the selection circuit is not given here.

For the circuit components 141, 142, 143, 145, 146, 147 and 148, reference should be made to a combination of FIG. 1B and FIG. 6 for the basic circuit operation. The block identified as the time-pulse counter 42 is comparable to a series of the blocks 42 through 44 shown in FIGS. 1B and 1C, and the count delay timer 143 of FIG. 9 incorporates the delay function of each of the blocks 42 through 44 (and also 45 and 46) of FIG. 1B and FIG. 6. The functional operation of this portion of the circuit, however, is identical to that which has been described previously in conjunction with FIGS. 1B and 6.

Instead of a single relay for the entire traffic signal light (namely, all four directions), the outputs of the ciircuit shown in FIG. 9 are directional with one relay 148 controlling the North-South traffic light direction, and another relay 248 controlling the East-West direction. Whenever the North-South relay 148 is operated in response to a vehicle approaching from either the North or the South, a signal is applied to the traffic control equipment to cause the traffic signal light in the North and South direction to be turned green. This also causes the signal lights in the East and West directions to be turned red.

To prevent conflicting subsequent signals from occurring, operation of the North-South relay 148 also supplies a disable signal to the East-West control relay 248 to prevent that relay from producing a control output signal, so long as the North-South control relay 148 is operative. Thus, the relay 148 must be permitted to pass through its full-time cycle before the East-West control relay 248 can obtain control of the system. Consequently, when an amergency vehicle is passing through the intersection in a position which potentially could cause conflicting signals to be obtained from the various microphones, control already has been eatsblished and the time-out interval which has been described previously in conjunction with FIGS. 1A and 1B must run its course. This provides sufficient time for the emergency vehicle to clear the intersection before the signal light either resumes its normal operation or is captured for overriding control by another emergency vehicle approaching from the same or a different direction.

Whenever either the North-South control relay 148 or the East-West control relay 248 is activated, it immediately disables the other one of the two control relays, so that only one of the two relays 148 and 248 may be activated at any given time. Consequently, when two emergency vehicles are approaching the intersection 99 at right angles, the nearest one preempts the traffic light in its favor until that vehicle clears the intersection. When siren sweep cycles no longer are detected, the turn-off delay timer 145 or 245, which is externally adjustable, deactivates its corresponding control relay 148 or 248 after any desired pre-set timer period.

The control relays 148 and 248 both have normally-open and normally-closed contacts available which may be used to provide appropriate logic signals to solid-state traffic control equipment. Alternatively, these outputs may be used diectly to actuate relays in relay-type traffic controllers. In the case of older mechanical equipment, it may be necessary to add auxiliary relays to override the light control timers in that equipment.

As mentioned previously, the extreme flexibility of the circuits comprising this invention permits them to be adjusted to recognize almost any repetitive or nonrepetitive sound pattern to the complete exclusion of other unwanted sounds. As such, this invention may be used for any other application in which it is necessary to recognize a particular sound amongst an unpredictable variety of other sounds. In view of this, various changes could be made to the above-described electronic system without departing from the scope of the invention and it is intended that all the details in the descriptions in the figures be interpreted as purely illustrative and totally nonlimiting.

I claim:

1. A sound discrimination system for use in an environment subject to a plurality of sounds of various frequencies and combinations of frequencies, said system including in combination:

first amplifier means having first and second inputs;

first and second diametrically opposed sound pickup means differentially connected to the first and second inputs of said first amplifier means to permit passage of signals from said first and second sound pickup means therethrough in response to a difference in signal strength from said first and second sound pickup means greater than a predetermined amount;

second amplifier means having first and second inputs;

third and fourth diametrically opposed sound pickup means arranged on a line at an angle to a line between said first and second sound pickup means, said third and fourth sound pickup means being differentially connected to first and second inputs of said second amplifier means to permit passage of signals from said third and fourth sound pickup means therethrough whenever the signal strength from said third and fourth sound pickup means differs by more than a predetermined amount;

first and second processing circuits connected, respectively, to the outputs of said first and second amplifier means, each of said processing circuits comprising:

(a) a pluralty of means for selectively detecting and recognizing predetermined sound signals at different frequencies within the audio frequency spectrum of said particular sound pattern, each of said sound detecting and recognizing means producing an output signal in response to such detection and recognition of said second sound signal;

(b) control means for producing an output control signal for said system in response to receipt of a signal on the input thereof;

(c) a plurality of time delay circuit means each coupled with the output of a different corresponding one of said detecting and recognizing means for producing an enable signal ater a predetermined time delay, each of said time delay circuit means coupled with the next one of said time delay circuit means in the sequence for producing an enable signal thereto in a predetermined sequence, with the output of the last time delay circuit means coupled with said input of said control means; and (d) means interconnecting said control means in each of said channels with one another for preventing operation of said control means from said second channel when said first channel control means is operated and vice-versa.

2. The combination according to claim 1 wherein each of said detecting and recognizing means is coupled to two different time delay circuit means, one of which is in a first set for combinations of sounds of different frequencies recognized by said detecting and recognizing means in a first sequential order and the other of which is in a second set of time delay circuit means for enabling the outputs of said detecting and recognizing means in a reverse sequential order to said first order to produce an output signal to the input of said control means from the output of the last one of said time delay circuit means in said second set of time delay circuit means.

3. A sound discrimination system according to claim 2 further including repetition detection means coupled between the output of said last time delay circuit means and the input of said control means for supplying a signal to the input of said control means upon receipt of a predetermined number of outputs from said last time delay circuit means.

4. The combination according to claim 3 further including timer means coupled to the output of said last time delay circuit means and operated in response to a signal received thereby for resetting said repetition detection means a predetermined time interval after receipt of the last signal from said last time delay circuit means.

5. The combination according to claim 4 wherein said repetition detecting means comprises a plurality of cascaded control counters, the first of which is triggered to produce an enable pulse by the first output signal from said last time delay time circuit means and wherein each of said control counters is enabled by the preceding counter in said cascade to be triggered for operation by successive output signals from said last time delay time circuit means, with the last counter in said cascade producing the signal coupled to the input of said control means.

6. A sound discrimination system according to claim 5 further including repetition detection means in each of said first and second processing circuits, said repetition detection means coupled between the output of said last time delay circuit means and the input of said control means for supplying a signal to the input of said control means upon receipt of a predetermined number of outputs from said last time delay circuit means.

7. The combination according to claim 6 further including timer means in each of said first and second processing circuits coupled to the output of said last time delay circuit means and operated in response to a signal received thereby for resetting said repetition detection means a predetermined time interval after receipt of the last signal from said last time delay circuit means.

* * * * *